US009770386B2

(12) United States Patent
Johnson

(10) Patent No.: US 9,770,386 B2
(45) Date of Patent: Sep. 26, 2017

(54) SAUNA HEATING APPARATUS AND METHODS

(71) Applicant: High Tech Health International, Inc., Boulder, CO (US)

(72) Inventor: Erik Johnson, Boulder, CO (US)

(73) Assignee: High Tech Health International Inc., Boulder, CO (US)

( * ) Notice: Subject to any disclaimer, the term of this patent is extended or adjusted under 35 U.S.C. 154(b) by 414 days.

(21) Appl. No.: 14/467,003

(22) Filed: Aug. 23, 2014

(65) Prior Publication Data

US 2016/0051440 A1 Feb. 25, 2016

(51) Int. Cl.

| | |
|---|---|
| ***H05B 3/20*** | (2006.01) |
| ***F24H 9/00*** | (2006.01) |
| ***A61H 33/06*** | (2006.01) |
| ***H05B 3/26*** | (2006.01) |
| ***A61H 33/00*** | (2006.01) |

(52) U.S. Cl.

CPC ..... *A61H 33/063* (2013.01); *A61H 33/066* (2013.01); *A61H 33/6005* (2013.01); *H05B 3/26* (2013.01); *A61H 2201/0228* (2013.01); *H05B 2203/014* (2013.01)

(58) Field of Classification Search

None

See application file for complete search history.

(56) References Cited

U.S. PATENT DOCUMENTS

| | | | | | |
|---|---|---|---|---|---|
| 4,855,572 | A * | 8/1989 | Wallgren | B23K 1/018 | 219/209 |
| 4,882,466 | A * | 11/1989 | Friel | H01C 1/1406 | 219/219 |
| 5,157,240 | A * | 10/1992 | Chow | C23C 14/243 | 219/444.1 |
| 5,410,127 | A * | 4/1995 | LaRue | H05B 3/342 | 219/212 |
| 5,908,573 | A * | 6/1999 | Chiles | F24D 13/02 | 219/213 |
| 6,734,404 | B2 * | 5/2004 | Hays | H05B 3/56 | 219/211 |
| 7,329,843 | B2 * | 2/2008 | Bikhovsky | A61F 7/007 | 219/528 |
| 8,138,760 | B2 * | 3/2012 | Bulatowicz | G01R 33/31 | 324/315 |
| 8,692,168 | B2 * | 4/2014 | Benda | A61H 33/063 | 219/213 |
| 2003/0121140 | A1 * | 7/2003 | Arx | A47J 36/2483 | 29/611 |
| 2003/0156831 | A1 * | 8/2003 | Schaeffer | A61N 5/06 | 392/416 |
| 2003/0183620 | A1 * | 10/2003 | Wong | H05B 3/34 | 219/549 |

(Continued)

*Primary Examiner* — Thor Campbell

(74) *Attorney, Agent, or Firm* — Mark Gonzales

(57) ABSTRACT

In one embodiment, the present invention includes an infrared apparatus to heat a body. The infrared apparatus includes layers. The first layer has a first conductive path coupled to pass a first current. The second layer has a second conductive path running coincident to the first conductive path. The second layer terminates an electric field produced within said first layer. The first conductive path includes a resistive element that produces heat from the current.

21 Claims, 7 Drawing Sheets

(56) References Cited

U.S. PATENT DOCUMENTS

| | | | | |
|---|---|---|---|---|
| 2004/0173598 | A1* | 9/2004 | Ito | H01L 21/67103 219/444.1 |
| 2007/0145041 | A1* | 6/2007 | Shim | H05B 6/108 219/635 |
| 2011/0081135 | A1* | 4/2011 | Felder | A21C 15/002 392/407 |

* cited by examiner

SAUNA HEATING APPARATUS AND METHODS

CROSS REFERENCE TO RELATED APPLICATIONS

Not applicable.

BACKGROUND

The present invention relates to heating apparatus, and in particular, sauna heating apparatus and methods.

A sauna is a small room used to provide a hot-air bath for sweating out toxins from the body. Electrical heaters have replaced older types of traditional methods of generating heat in many applications. Electrical heaters are relatively a new development in sauna design and innovations may be possible with sauna heating apparatus and methods.

SUMMARY

Embodiments of the present invention include an infrared apparatus to heat a body. The infrared apparatus comprises layers. The first layer has a first conductive path coupled to pass a first current. The second layer has a second conductive path running coincident to the first conductive path. The second layer terminates an electric field produced within said first layer. The first conductive path includes a resistive element that produces heat from the current.

In one embodiment, said second conductive path is metal which reduces the potential at said second layer.

In another embodiment, the invention further comprises a third layer situated between the body and the first layer. The third layer has a third conductive path running coincident to the first and second conductive paths. The third layer produces heat. The first conductive path is coupled to redirect the current to the third conductive path and set up complimentary magnetic fields between the first and third layers Embodiments of the present invention also include a method to heat a body. The method includes providing current, terminating an electric field and producing heat. The providing current includes providing a first current along a first conductive path of a first layer. The producing heat includes the first layer producing heat from the first current. The terminating includes a second layer terminating an electric field produced within the first layer. The second layer has a second conductive path which runs coincident to the first conductive path. The first conductive path includes a resistive element that produces heat from the current.

Embodiments of the present invention also includes a sauna. The sauna comprises a room and at least one infrared apparatus. The room has a plurality of walls and the plurality of walls form an internal space. The infrared apparatus comprises layers. The first layer has a first conductive path coupled to pass a first current. The second layer has a second conductive path running coincident to the first conductive path. The second layer terminates an electric field produced within the first layer. The first conductive path includes a resistive element that produces heat from the current. The heat radiates toward the internal space. At least a portion of the infrared apparatus is coupled to at least one wall of the plurality of walls.

The following detailed description and accompanying drawings provide a better understanding of the nature and advantages of the present invention.

DETAILED DESCRIPTION

Described herein are techniques for sauna heating apparatus and methods. In the following description, for purposes of explanation, numerous examples and specific details are set forth in order to provide a thorough understanding of the present invention. It will be evident, however, to one skilled in the art that the present invention as defined by the claims may include some or all of the features in these examples alone or in combination with other features described below, and may further include modifications and equivalents of the features and concepts described herein.

Figure 1:
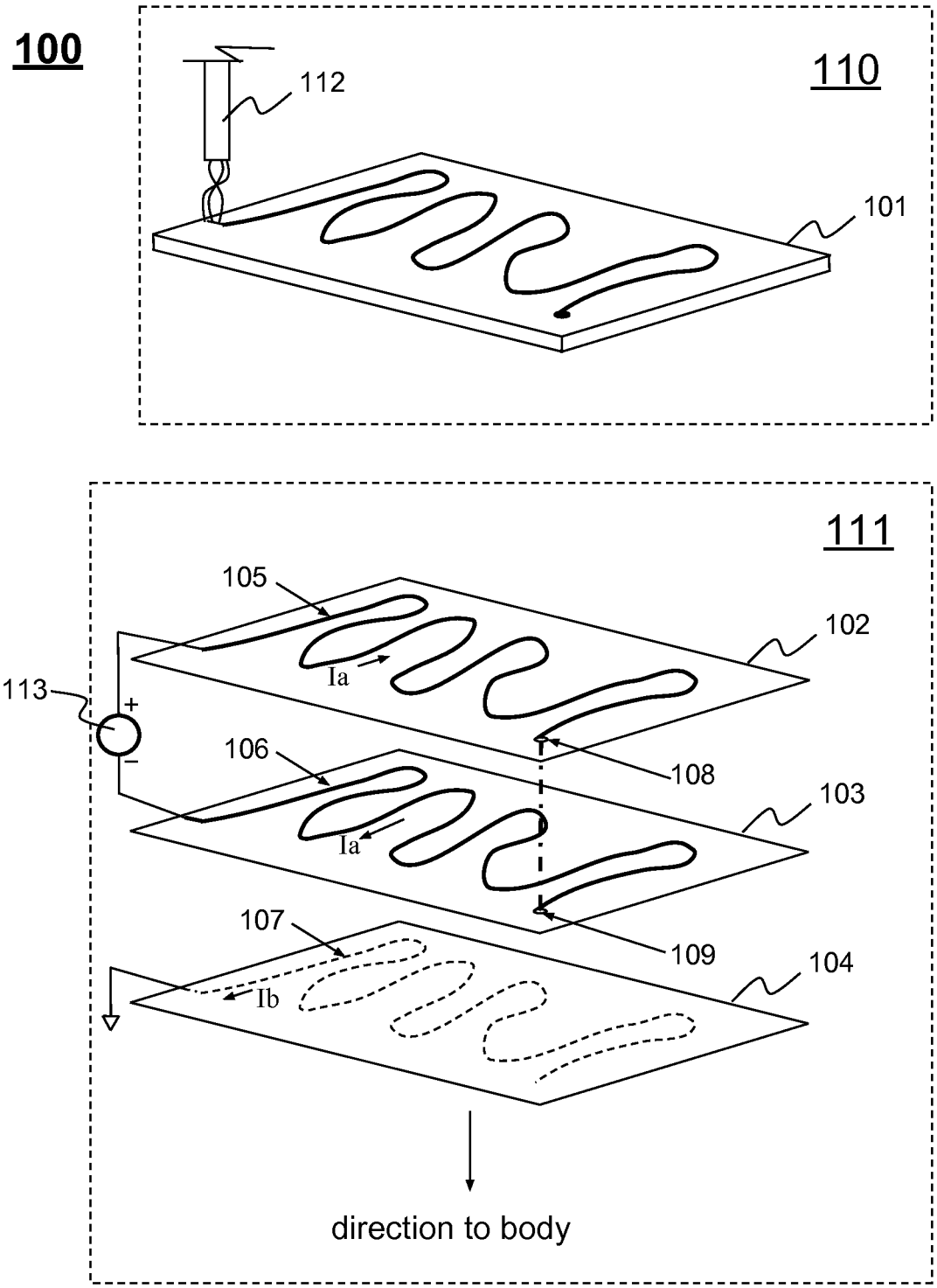
FIG. 1 illustrates views of an infrared apparatus to heat a body according to one embodiment of the invention.

FIG. 1 illustrates views 110-111 of an infrared apparatus 100 to heat a body according to one embodiment of the invention. View 110 illustrates printed circuit board (PCB) 101 having a twisted pair cable 112 to provide power to PCB 101. View 111 illustrates an exploded view of PCB 101. PCB 101 includes layers 102-104. Layer 102 has conductive path 105 which may be coupled to source 113 to pass current Ia. Conductive path 105 may take any route and be of any width or height which is able to be produced. The route of conductive path 105 may be designed to produce a more uniform heat. Alternatively, the route of conductive path 105 may be designed to focus the heat generated.

Layer 103 has conductive path 106 running coincident to conductive path 105. Conductive path 105 is coupled between point 108 and 109 to redirect the current Ia to conductive path 106 and set up complimentary magnetic fields between layers 102-103. Layer 102 produces heat from current Ia.

Conductive path 105 may include a resistive element that produces the heat. Conductive path 106 may be metal which reduces the potential at layer 106. This may allow layer 106 to terminate the electrical field generated in layer 105.

Infrared apparatus 100 may also include layer 104 situated between the body and layer 103. Layer 104 may have conductive path 107 running coincident to conductive paths 105-106. In the case in which layers 102-103 produce heat, layer 104 may provide blocking of electric fields generated from layers 102-103, and conductive path 107 may provide current Ib which is less than one thousandths of current Ia. Layer 104 may radiate the heat. Layer 104 may be coupled to earth ground.

FIG. 2A-G illustrates printed circuit board stackups 211-217 according to other embodiments of the invention. Stackup 211-217 includes layers 201-209. Layers 201-204 may each have conductive paths and layers 205-209 may be electrically insulative planar substrates. Layers 202-203 may be similar to layers 102-103 of FIG. 1. Layers 205-209 may be FR4 material. Layers 205-209 may be made from mica.

Figure 2A:
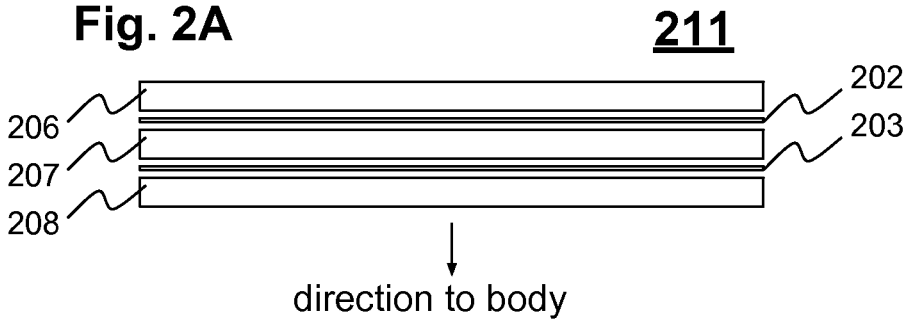
FIG. 2A-G illustrates printed circuit board stackups according to other embodiments of the invention.

FIG. 2A illustrates a PCB stackup 211. Stackup 211 includes layers 202-203 having conductive paths, and layers 206-208 which may be electrically insulative planar substrates. The conductive path of layer 202 may be coupled to the conductive path of layer 203 to pass a current in a similar manner as described in FIG. 1 above. Layer 203 may be made of metal and layer 202 may have resistive elements to produce heat. Alternately, layers 202-203 may both include resistive elements to produce heat. The heat produced may be transferred to layers 206-208. Layers 208 may be made of a material which may radiate the heat to the body as indicated. Layers 206-207 may be made of similar material (e.g. FR4) to simplify manufacturing, or layers 206-207 may be made of different material. For example, layer 206 may be made of a heat insulative material such that heat is not dissipated in a direction away from the body. Also, for example, layer 207 may be made of a heat conducting material to aid in the transfer of heat toward layer 208. Layer 207 may be made thinner than layer 208 to aid in that heat transfer to the body.

Figure 2B:
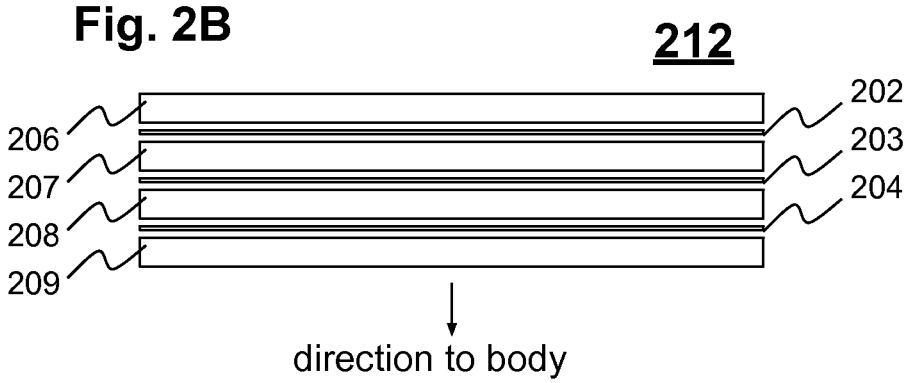

FIG. 2B illustrates a PCB stackup 212. Stackup 212 includes layers 202-204 having conductive paths and layers 206-209 which may be electrically insulative planar substrates. Layers 202-203 and 206-207 may function as described in FIG. 2A. Layer 208 may be made of a heat conductive material or made of similar material as layers 206-207. Layer 204 may be a conductive plane coupled to a low potential. Layer 204 may be brought closer to layers 202-203 by minimizing the width of layer 208. This may increase heat conduction through layer 208 and also decrease fringing of electrical fields produced by layers 202-203. Layer 209 may be made of a material that radiates heat which has been transferred from layer 202 or from both layer 202 and layer 203.

Figure 2C:
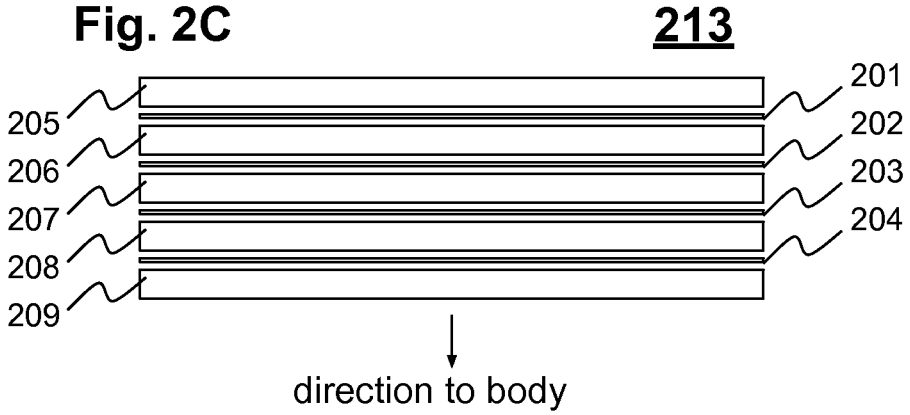

FIG. 2C illustrates a PCB stackup 213. Stackup 213 includes layers 201-204 having conductive paths and layers 205-209 which may be electrically insulative planar substrates. Layers 202-204 and 207-209 may function as described in FIG. 2A-B. Layer 201 may be a conductive plane coupled to a low potential such as ground, for example. Layer 205 may insulate heat. In an alternate embodiment, layer 205 may radiate heat and there may be a second body in the opposite direction of the body indicating, thereby allowing the heating apparatus to heat two separate chambers or direct heat in two opposing directions.

Figure 2D:
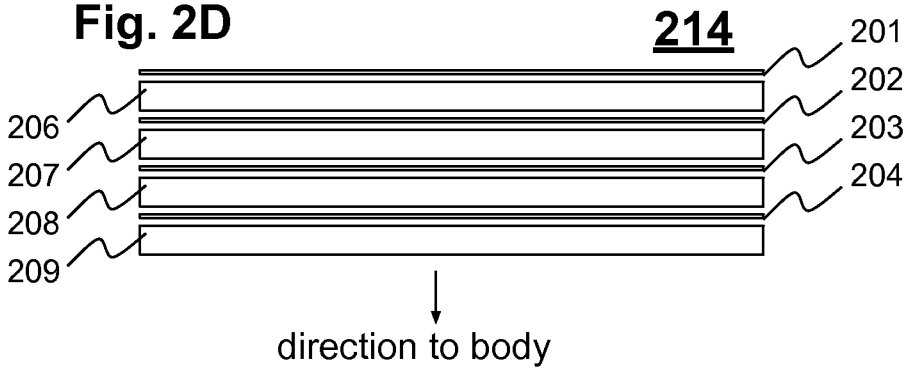

FIG. 2D illustrates a PCB stackup 214. Stackup 214 includes layers 201-204 having conductive paths and layers 206-209 which may be electrically insulative planar substrates. Layers 202-204 and 206-209 may function as described in FIG. 2A-C. Layer 201 may be a conductive plane as described above. Alternately, layer 201 may be a mesh. Layer 201 may be metal having a grating of less than or equal to ⅛ inch. Any greater size of grating will have a reduction in ability to block the electric fields generated from layers 202-203.

Figure 2E:
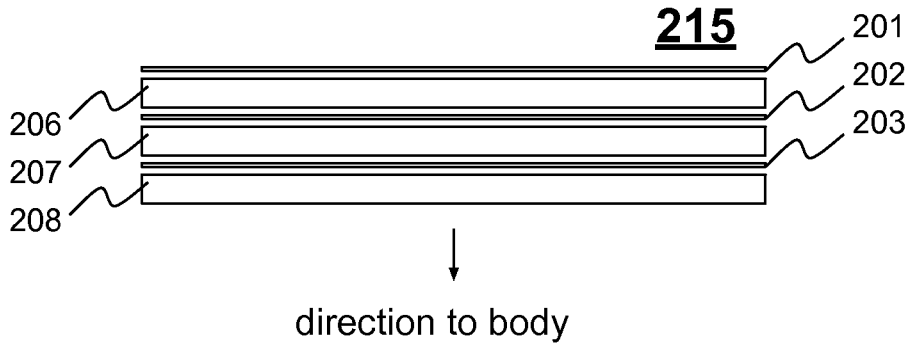

FIG. 2E illustrates a PCB stackup 215. Stackup 215 includes layers 201-203 having conductive paths and layers 206-208 which may be electrically insulative planar substrates. Layers 201-203 and 206-208 may function as described in FIG. 2A-D. Layer 208 may radiate heat to the body. Stackup 215 may be used as a minimal stackup that prevents electric fields from being propagated outside a sauna. In this embodiment, layer 203 may be made of metal in order to reduce the potential at layer 203 and provide some blocking of electrical fields being propagated toward the body.

Figure 2F:
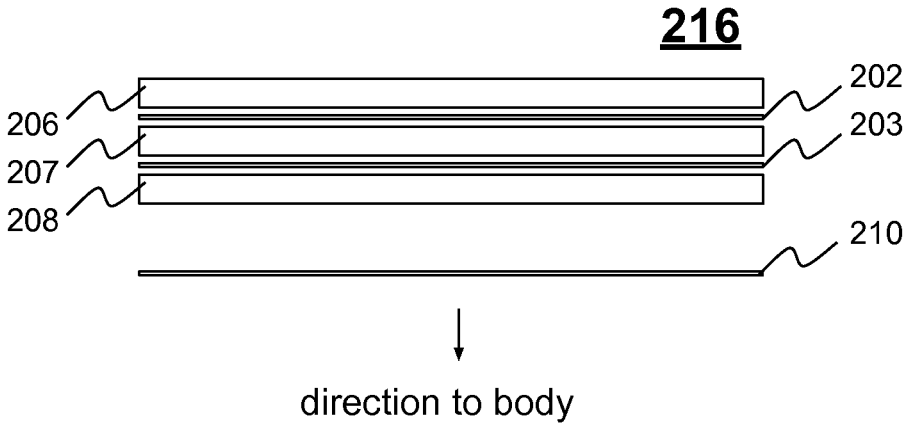

FIG. 2F illustrates a PCB stackup 216. Stackup 216 includes layers 202-203 having conductive paths and layers 206-208 which may be electrically insulative planar substrates. Layers 202-203 and 206-208 may function as described in FIG. 2A. Layer 210 may not be part of stackup 216. Layer 210 may be a conductive fabric attached to a cover in an enclosure residing the PCB. Layer 210 may be coupled to earth ground through the panel frame holding the conductive fabric. Alternately the conductive fabric may be part of a seat back cushion within the sauna.

Figure 2G:
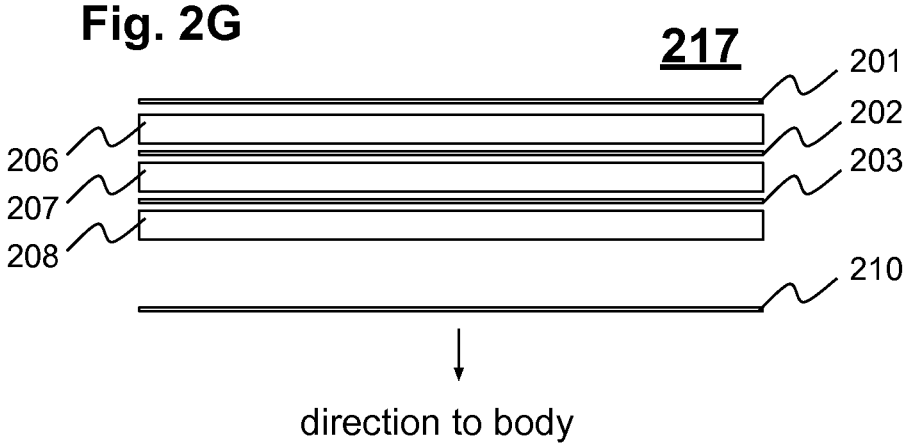

FIG. 2G illustrates a PCB stackup 217. Stackup 217 includes layers 201-203 having conductive paths and layers 206-208 which may be electrically insulative planar substrates. Layers 201-203 and 206-208 may function as described in FIG. 2A-F. Layer 210 and 201 may act as blocks to electrical fields. Layer 206 may be heat insulative such that layer 201 may not get above 30 degrees Centigrade.

FIG. 3A-D illustrates a layer 300 and corresponding detail views according to other embodiments of the invention. Layer 300 includes metal traces 301, resistive elements 302, connection 303, and via array 304. This shows the top view of layer 300 where the direction of the body is into the page. Layer 300 may be similar to layers 202-203 of FIG. 2A-G, for example.

Connection 303 provides an electrical current to metal traces 301 and resistive elements 302. The current flows from connection 303 to via array 304. The current drops down to layer 306. Layer 306 may be almost identical to the first such that the current is redirected such that the magnetic fields generated on layer 300 are cancelled by the magnetic fields generated on layer 306. The conductive paths of layer 300 and this second layer are said to be coincident because they lie one on top of the other in the stackup of layers.

Figure 3A:
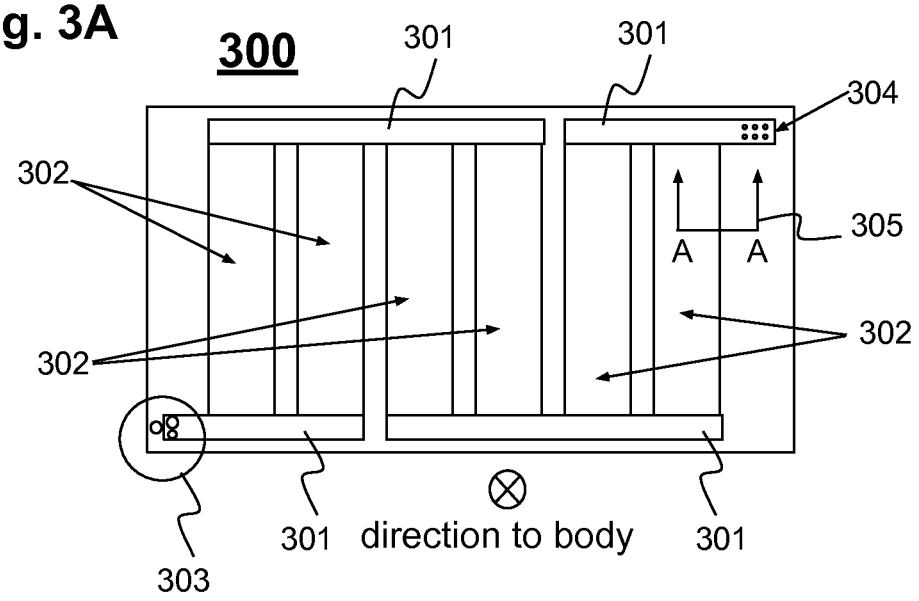
FIG. 3A-D illustrates a layer and corresponding detail views according to other embodiments of the invention.
Figure 3B:
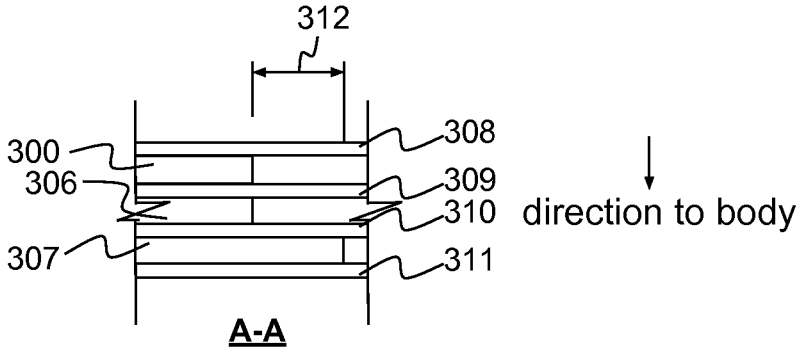

FIG. 3B includes a detail A-A of one embodiment of the invention. Layers 300, 306-307 have conductive paths. Layers 300 and 306 have resistive elements which produce heat, and layer 307 blocks electrical fields. Layers 308-311 may be electrically insulative planar substrates. Metal of layer 307 may superscribe the boundary of layer 300 and layer 306 by more than five times a distance between layers 306 and 307. Distance 312 shows the boundary of metal of layer 307 superscribing a boundary of resistive element 302 of layer 306 by more than five times the distance between layers 306 and 307. The boundaries of resistive and/or conductive elements of layers 300 and 306 may be incidental as shown.

Figure 3C:
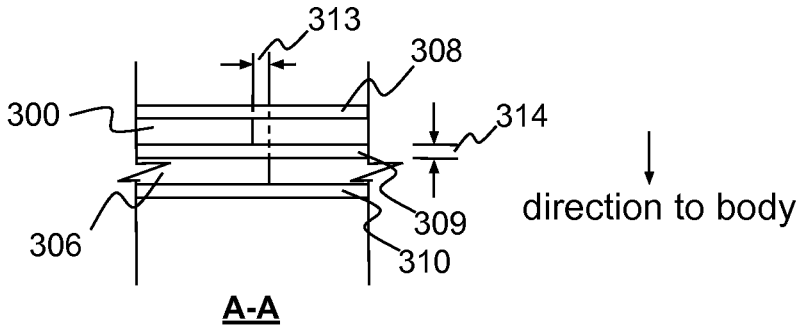

FIG. 3C includes a detail A-A of another embodiment of the invention. Layers 300 and 306 have conductive paths. Layers 308-310 may be electrically insulative planar substrates. Layer 300 has resistive elements which produce heat, and layer 306 is of metal which reduces the potential at layer 306. Layer 306 may aid in reducing the electric field propagating in the direction of the body. The metal of layer 306 may superscribe the boundary of layer 300 by more than a distance 314 between layers 300 and 306. Distance 313 shows the boundary of the metal of layer 306 superscribing a boundary of resistive element 302 of layer 300 by more than a distance 314.

Figure 3D:
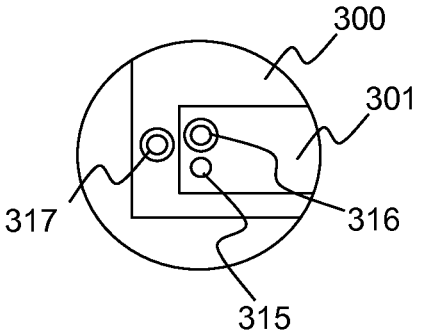

FIG. 3D includes detail 303 of yet another embodiment of the invention. Layer 300 has an end portion of trace 301. Connection point 315 lies at the end of the conduction path. Connection point 315 may be coupled to provide current. Connection point 316 lies on layer 306 through an opening in an end of the conductive path on layer 300. Connection point 316 may be coupled to provide a return path for the current. In one embodiment, connection point 317 lies on layer 307 through an opening in an end of the paths on layer 300 and 306. Connection point 317 may be connected to earth ground or some other low voltage point.

In a preferred embodiment connection points 315-316 are adjacent to each other and perpendicular to the conduction paths at the end of layers 300 and 306. Connection point 317 may be placed in close proximity to connection points 315-316. Connection points 315-317 may form an equilateral triangle allowing a shielded twisted pair cable to be coupled to the points with minimal radiation of both electric and magnetic fields.

Figure 4:
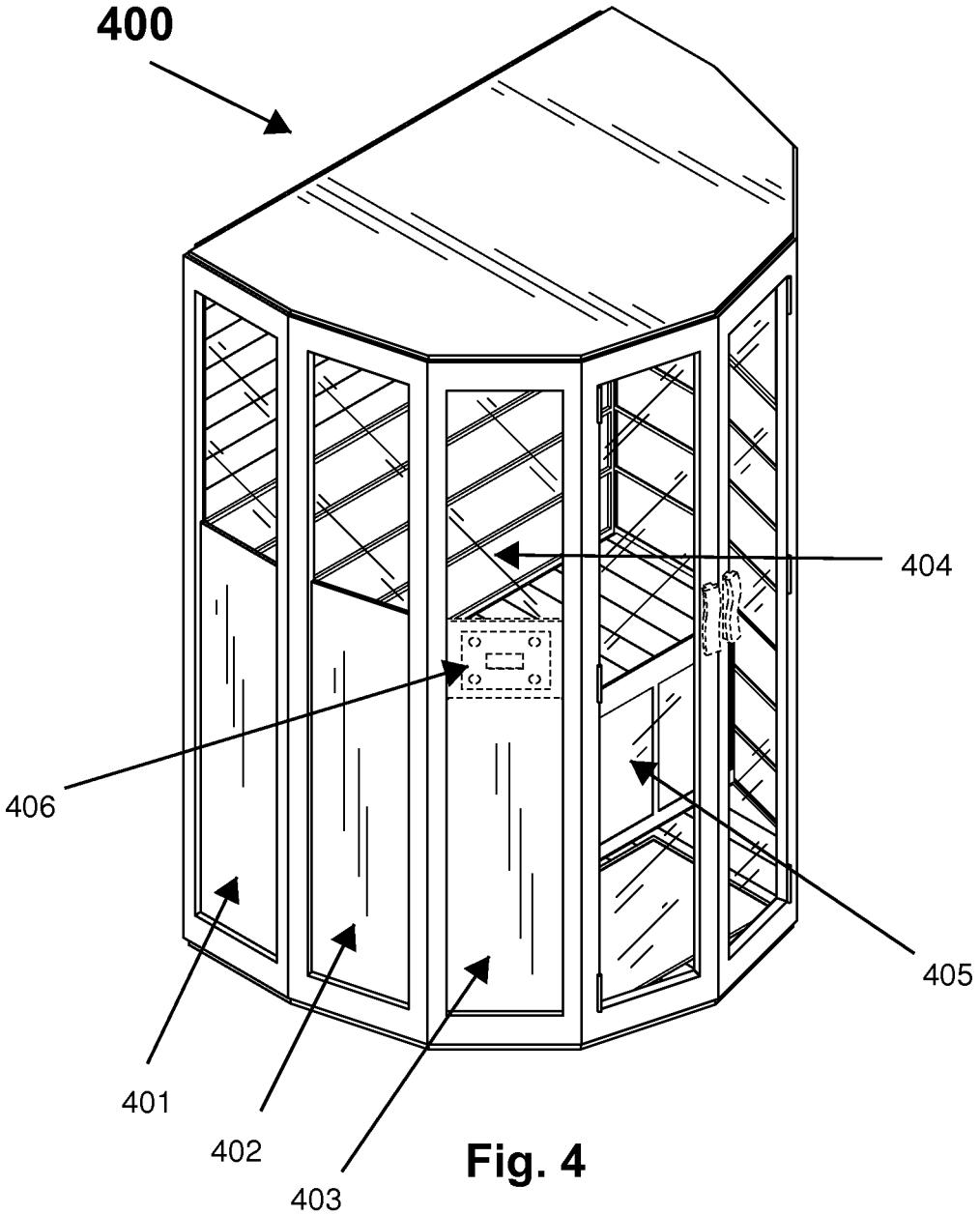
FIG. 4 illustrates a sauna according to yet another embodiment of the invention.

FIG. 4 illustrates a sauna 400 according to yet another embodiment of the invention. Sauna 400 includes a room and at least one infrared apparatus 400. The room has a plurality of walls (e.g. 401-403). The plurality of walls form an internal space in which a body may be heated. Infrared apparatus 404 may be located on the back wall of the sauna 400. In fact, many of the panels may be equipped with an infrared apparatus to heat the body of a person. Additional infrared apparatus 405 may be placed at the foot of the seating bench as well.

Additionally, every wall may be outfitted with an infrared apparatus. At least a portion of at least one infrared apparatus is coupled to at least one wall of the plurality of walls. The number of infrared apparatus may be determined by the desired final temperature and/or the speed at which the sauna is designed to reach its set temperature. Infrared apparatus 404-405 radiates heat toward the internal space of sauna 400.

In one embodiment, there may be a plurality of infrared apparatus to heat the body. The plurality may be controlled by controller 406. Controller 406 may pulse a number of infrared apparatus at a rate commensurate with the heating requirements. For example, infrared apparatus 405 may not be on as consistently as infrared apparatus 404 because the area at the foot of the enclosure may easily come to temperature. The plurality of infrared apparatus may allow for a much lower current to be used overall (i.e. higher resistive elements) so that the overall magnetic fields are minimized. These infrared apparatus panels may be made less expensive and a single supply (not shown) by used to multiplex between the infrared apparatus of sauna 400 Infrared apparatus 404 may have conductive fabric which may be coupled to earth ground such that electric fields are minimized. This conductive fabric may be part of a backrest cushion integrated as part of sauna 400

Figure 5:
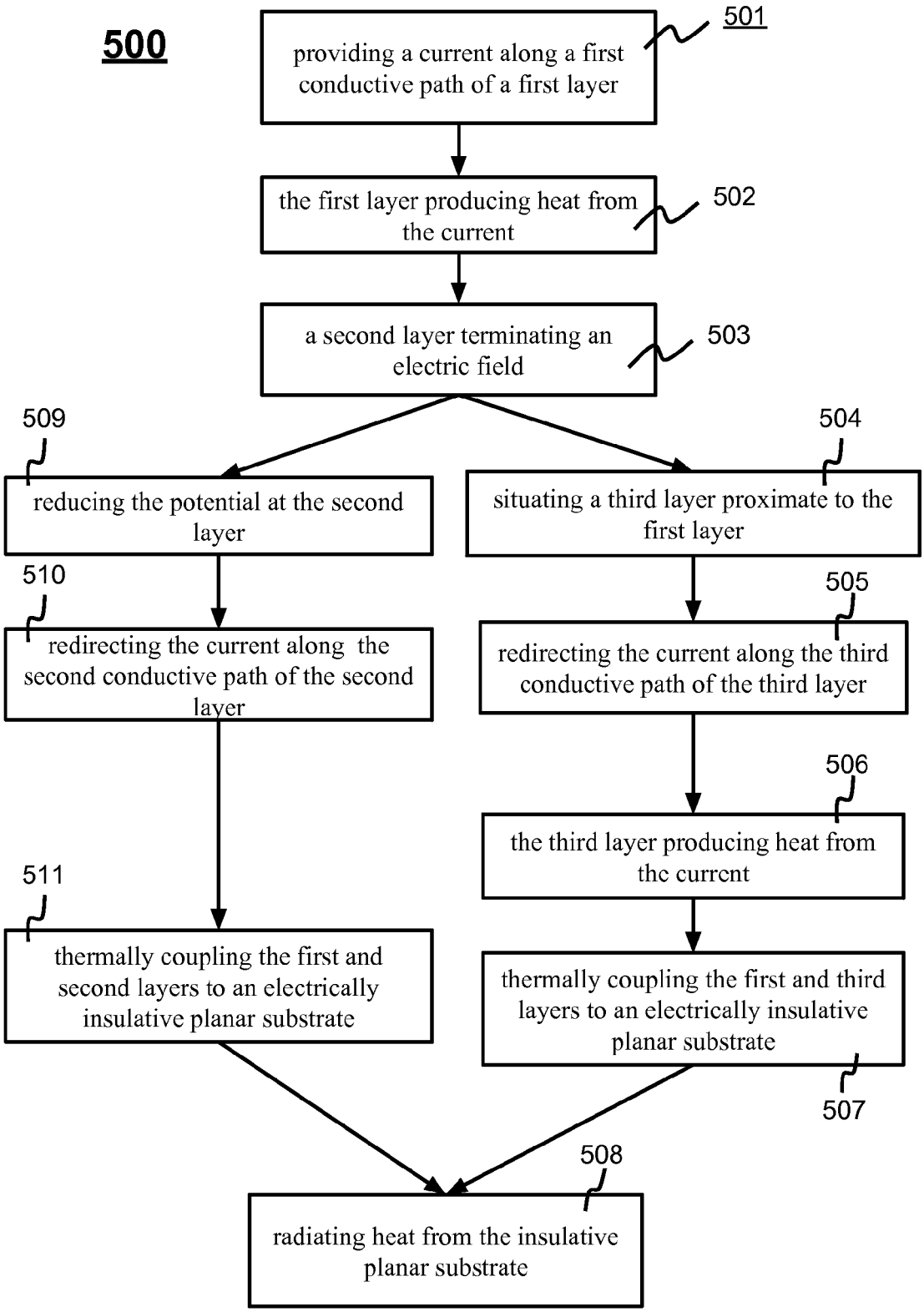
FIG. 5 illustrates a method of heating a body according to another embodiment of the invention.

FIG. 5 illustrates a method 500 of heating a body according to another embodiment of the invention.

At 501, provide a first current along a first conductive path of a first layer.

At 502, the first layer produces heat from the current. The first conductive path may include a resistive element that produces the heat from the current.

At 503, the second layer terminates an electric field produced within the first layer. The second layer has a second conductive path coincident with the first conductive layer.

At 504, situate a third layer proximate to the first layer. The third layer has a third conductive path running coincident to the first and second layers, and the third layer produces heat from the current. The second layer is situated between the body and the first and third layers.

At 505, the first conductive path is coupled to redirect the current to the third conductive path and set up complimentary magnetic fields between the first and third layers.

At 506, the third layer produces heat from the current.

At 507, thermally couple the first and third layers to an electrically insulative planar substrate.

At 508, radiate heat from the insulative planar substrate.

Alternatively to 504, at 509, reduce the potential at the second layer.

At 510, redirect the current along the second conductive path of the second layer.

At 511, thermally couple the first and second layers to an electrically insulative planar substrate.

At 508, radiate heat from the insulative planar substrate.

Figure 6:
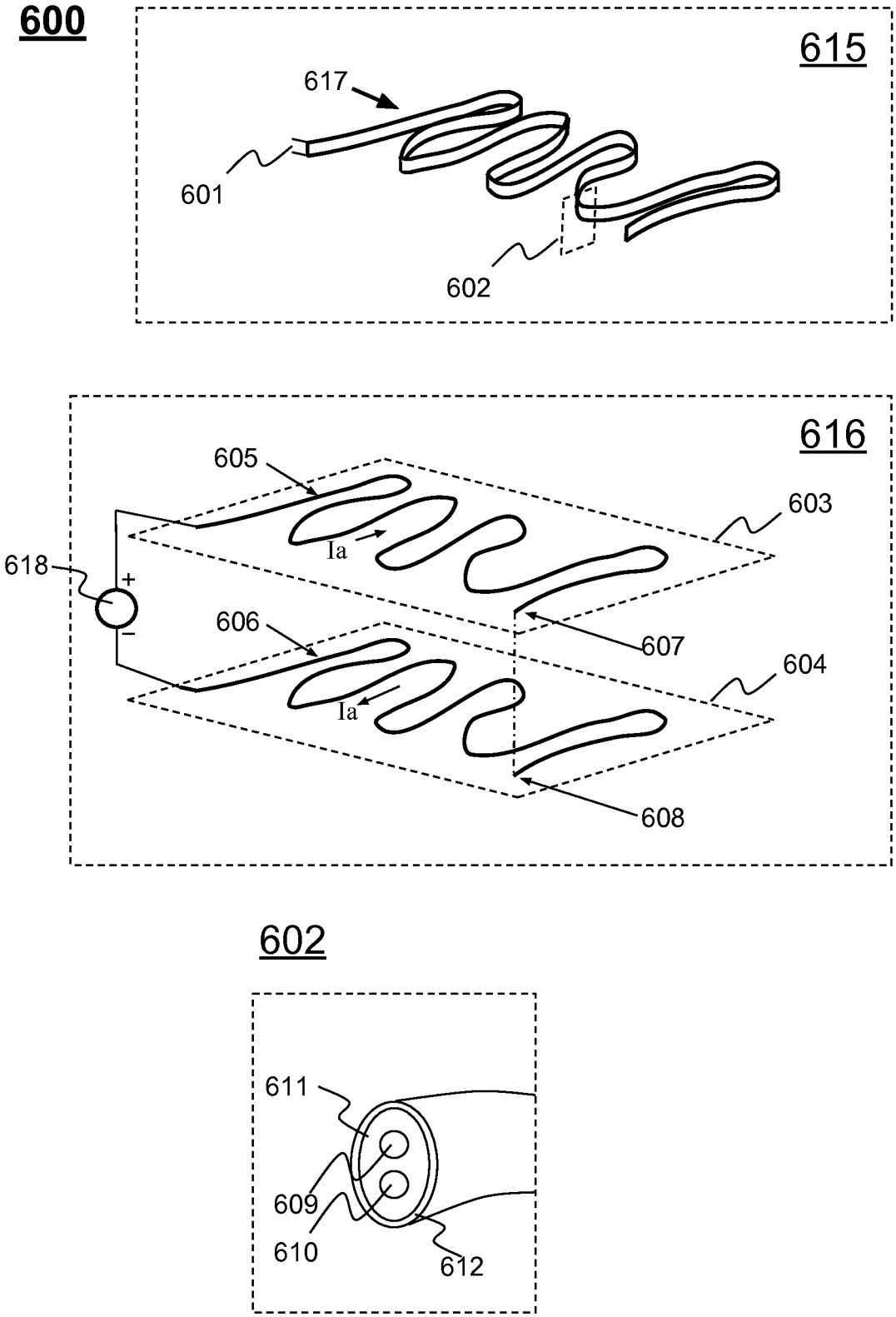
FIG. 6 illustrates views of an infrared apparatus to heat a body according to one embodiment of the invention.

FIG. 6 illustrates views 615-616 and 602 of an infrared apparatus 600 to heat a body according to one embodiment of the invention. View 615 illustrates rigid core wire form 617 having connectors 601 to provide power, and also illustrates cutaway 602 corresponding to view 602. View 616 illustrates an exploded view of rigid wire form 617. Rigid wire form 617 includes layers 603-604. Layer 603 has conductive paths 605-606 wrapped in a sheath 612 (see view 602). Center conductor 609 (see view 602) of conductive path 605 may be coupled to source 618 to pass current Ia. Layer 603 has conductive path 605 running coincident to conductive path 606. Conductive path 605 is coupled between point 607 and 608 to redirect the current Ia to conductive path 606 and set up complimentary magnetic fields between layers 603-604. Rigid core wire form 617 produces heat from current Ia flowing in layer 603-604.

Detailed view 602 is taken from view 615. View 602 shows a cut-away view of the rigid wire form 617. Center conductor 609-610 may be nichrome wire. Electrical insulator 611 surrounds center conductors 609-610. Electrical insulator 611 may be made of magnesium oxide. Electrical insulator 611 may also be a good heat conductor. Sheath 612 may be metal such as copper, for example. Sheath 612 may radiate the heat. Sheath 612 may have a coating which radiates heat well.

The above description illustrates various embodiments of the present invention along with examples of how aspects of the present invention may be implemented. The above examples and embodiments should not be deemed to be the only embodiments, and are presented to illustrate the flexibility and advantages of the present invention. Based on the above disclosure, other arrangements, embodiments, implementations and equivalents will be evident to those skilled in the art and may be employed without departing from the spirit and scope of the invention.

What is claimed is:

1. An infrared apparatus to heat a body, said infrared apparatus comprising:
- a first layer having a first conductive path coupled to pass a current; and
- a second layer having a second conductive path running coincident to said first conductive path,
- a third layer having a third conductive path running coincident to said first and second conductive paths,
- wherein said third layer produces heat,
- wherein said second layer is situated between said body and said first and third layers and
- wherein said first conductive path is coupled to redirect said current to said third conductive path and set up complimentary magnetic fields between said first and third layers,
- wherein said second layer terminates an electric field produced within said first layer, and wherein said first conductive path includes a resistive element that produces heat from said current.

2. The infrared apparatus of claim 1 wherein said second conductive path is metal which reduces the potential at said second layer.

3. The infrared apparatus of claim 1 further comprising:
- a first connection point at the end of said first conduction path; and
- a second connection point to said second layer through an opening in an end of said first conductive path, wherein said first and second connection points are adjacent to each other and perpendicular to said first and second conduction paths.

4. The infrared apparatus of claim 1 further comprising an electrically insulative planar substrate, wherein said first and second layers are thermally coupled to said electrically insulative planar substrate, and wherein said electrically insulative planar substrate radiates heat.

5. The infrared apparatus of claim 1 wherein said second conductive path provides a second current which is less than one thousandths of said first current.

6. The infrared apparatus of claim 1 wherein said second layer radiates heat.

7. The infrared apparatus of claim 1 wherein said second layer is made of metal having a grating of less than or equal to ⅛ inch.

8. The infrared apparatus of claim 1 wherein said second layer is coupled to earth ground.

9. The infrared apparatus of claim 1 wherein said second layer is a conductive fabric.

10. The infrared apparatus of claim 1 further comprising an electrically insulative planar substrate, wherein said first and third layers are thermally coupled to transfer heat to said electrically insulative planar substrate, and wherein said electrically insulative planar substrate radiates heat.

11. The infrared apparatus of claim 10 wherein said second layer superscribes a boundary of said third layer by more than a distance between said second and third layers.

12. A method to heat a body, said method comprising:

providing a current along a first conductive path of a first layer;

said first layer producing heat from said first current;

a second layer terminating an electric field produced within said first layer, said second layer having a second conductive path coincident with said first conductive path;

situating a third layer proximate to said first layer, said third layer having a third conductive path running coincident to said first and second layers; and said third layer producing heat from said current, wherein said second layer is situated between said body and said first and third layers, wherein said first conductive path is coupled to redirect said current to said third conductive path and set up complimentary magnetic fields between said first and third layers, and wherein said first conductive path includes a resistive element that produces heat from said current.

13. The method of claim 12 further comprising reducing the potential at said second layer, wherein said second conductive path is metal.

14. The method of claim 12 further comprising thermally coupling said first and second layers to an electrically insulative planar substrate, wherein said electrically insulative planar substrate radiates heat.

15. The method of claim 12 wherein said second conductive path provides a second current which is less than one thousandths of said first current.

16. The method of claim 12 further comprising said second layer radiating heat toward said body.

17. The method of claim 12 further comprising coupling said third layer to earth ground.

18. A sauna to heat a body, said sauna comprising:

a room having a plurality of walls, said plurality of walls forming an internal space; and at least one infrared apparatus, said infrared apparatus comprising, a first layer having a first conductive path to provide a first current;

a second layer having a second conductive path running coincident to said first conductive path; and a third layer situated proximate to said first layer, said third layer having a third conductive path running coincident to said first and second conductive paths, wherein said third layer produces heat, wherein said second layer is situated between said body and said first and third layers, wherein said first conductive path is coupled to redirect said current to said third conductive path and set up complimentary magnetic fields between the first and third layers, wherein said second layer terminates an electric field produced within said first layer, and wherein said first conductive path includes a resistive element that produces a heat from said current, said heat radiating toward said internal space, wherein at least a portion of said at least one infrared apparatus is coupled to at least one wall of said plurality of walls.

19. The sauna of claim 18 wherein said second conductive path is metal which reduces the potential at said second layer.

20. The sauna of claim 18 wherein said second conductive path provides a second current which is less than one thousandths of said first current.

21. The sauna of claim 18 wherein said second layer is a conductive fabric.

* * * * *